US010374309B2

(12) United States Patent
Sharawi

(10) Patent No.: US 10,374,309 B2
(45) **Date of Patent: *Aug. 6, 2019**

(54) SWITCHED BEAM ANTENNA SYSTEM AND HAND HELD ELECTRONIC DEVICE

(71) Applicant: KING FAHD UNIVERSITY OF PETROLEUM AND MINERALS, Dhahran (SA)

(72) Inventor: Mohammad Said Sharawi, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 320 days.

This patent is subject to a terminal disclaimer.

(21) Appl. No.: 15/606,007

(22) Filed: May 26, 2017

(65) Prior Publication Data

US 2017/0279197 A1 Sep. 28, 2017

Related U.S. Application Data

(63) Continuation of application No. 14/291,092, filed on May 30, 2014, now Pat. No. 9,692,126.

(51) Int. Cl.

| | |
|---|---|
| ***H01Q 3/40*** | (2006.01) |
| ***H01Q 9/04*** | (2006.01) |
| ***H01Q 21/00*** | (2006.01) |
| ***H01Q 21/06*** | (2006.01) |

(52) U.S. Cl.

CPC ..... *H01Q 3/40* (2013.01); *H01Q 9/0407* (2013.01); *H01Q 21/0006* (2013.01); *H01Q 21/065* (2013.01)

(58) Field of Classification Search

CPC ..... H01Q 3/40; H01Q 21/065; H01Q 9/0407; H01Q 21/0006

See application file for complete search history.

(56) References Cited

U.S. PATENT DOCUMENTS 4,965,605 A 10/1990 Chang et al.
5,561,397 A * 10/1996 Kumar ..... H03F 1/526 330/286

(Continued)

OTHER PUBLICATIONS

Olivier Lafond, et al., "Reconfigurable radiation pattern antennas in mm-waves", Microwave and Millimeter Wave Technologies Modern UWB antennas and equipment, Mar. 2010, (23 pages).

(Continued)

*Primary Examiner* — Frank J McGue

(74) *Attorney, Agent, or Firm* — Oblon, McClelland, Maier & Neustadt, L.L.P.

(57) ABSTRACT

A mm-wave antenna apparatus with beam steering function that includes: a Butler Matrix feeding network; a plurality of power combiners, each power combiner having one input and N outputs, configured to apply equal phase and power to a phase distributed output signal generated by the Butler Matrix feeding network and to generate N processed signals; and a plurality of millimeter wave switched beam planar antenna arrays having at least 1.5 GHz of bandwidth and located on a top low loss dielectric substrate, each antenna array of N elements, configured to obtain direct and narrow width beams from the N processed signals combined by each power combiner.

7 Claims, 9 Drawing Sheets

(56) References Cited

U.S. PATENT DOCUMENTS

| | | | | |
|---|---|---|---|---|
| 6,043,779 | A * | 3/2000 | Lalezari | H01Q 3/26 342/371 |
| 6,188,373 | B1 * | 2/2001 | Martek | H01Q 1/246 342/375 |
| 6,252,560 | B1 * | 6/2001 | Tanaka | H01Q 21/08 342/371 |
| 6,384,414 | B1 * | 5/2002 | Fisher | G01J 5/08 250/339.05 |
| 6,710,742 | B1 * | 3/2004 | Meredith | H01Q 3/28 342/372 |
| 8,013,784 | B2 | 9/2011 | Margomenos et al. | |
| 9,008,212 | B2 * | 4/2015 | Lovberg | H04L 27/2332 375/279 |
| 9,294,176 | B2 * | 3/2016 | Weiler | H01Q 3/40 |
| 9,374,145 | B2 * | 6/2016 | Angeletti | H01Q 3/40 |
| 2002/0171585 | A1 * | 11/2002 | Eiges | H01Q 1/28 342/373 |
| 2010/0321238 | A1 * | 12/2010 | Shen | H01Q 3/40 342/373 |

OTHER PUBLICATIONS

A.M. El-Tager, et al., "Design and Implementation of a Smart Antenna Using Butler Matrix for ISM-band", Progress in Electromagnetics Research Symposium, Beijing, China, Mar. 2009, (5 pages).

* cited by examiner

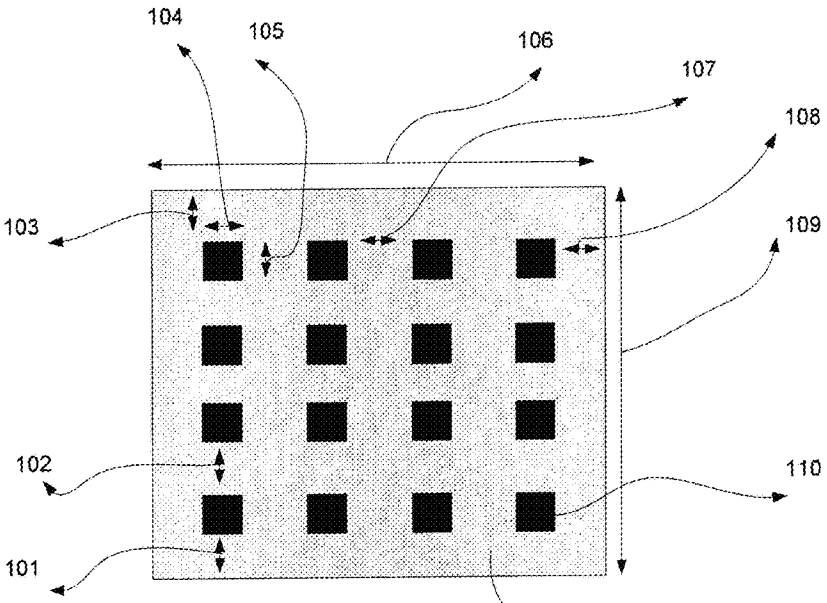
Figure 1(a)
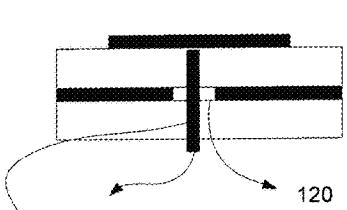
Figure 1(b)
Figure 1(c)

501
502
1
2
N 503
504
506
505

Butler Matrix + Combiners / Splitters
507

509
508

SWITCHED BEAM ANTENNA SYSTEM AND HAND HELD ELECTRONIC DEVICE

CROSS-REFERENCE TO RELATED APPLICATIONS

The present application is a continuation of Ser. No. 14/291,092, having a filing date of May 30, 2014.

BACKGROUND

Field of the Invention

The exemplary embodiments described herein are related to the field of low cost handheld and portable wireless short range communication systems that require higher frequency bands of operation to provide very high data throughput transmissions.

Background of the Invention

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Broadband wireless transmission is limited by the amount of power as well as the spectrum (bandwidth) allocated. In current wireless standards, both the power as well as the bandwidth is limited to avoid interference and to serve multiple wireless transmissions for civil and military use. Thus the achieved data rates have a limit. Although multiple-input-multiple-output (MIMO) technology has been used to enhance the data rates using multiple antennas at the receiver and transmitter sides, very high data rates that can ensure true digital video and multimedia transfer are still a major throughput bottleneck to higher transmission rates.

Wider bandwidth allocations can provide significant throughput improvements. Such wide spectrum is available at very high frequencies such as the 30-60 GHz and 70-90 GHz ranges. These bands cover millimeter waves (electromagnetic waves with wavelength of 10-1 mm). Millimeter waves suffer from very high attenuation when used in wireless links due to several channel conditions, and this restricted their use to point-to-point links and military use. Recently, these bands have been re-investigated for short range communications. Although the channel measurement curves show more than 15 dB/Km attenuation when operating at 60 GHz due to atmospheric absorption, the free space attenuation becomes much smaller when for indoor short range operation. This has triggered a totally new area of short range high data rate applications that can benefit from the extreme wideband at these very high frequencies.

For short range consumer electronics applications, the 28 GHz band of mm-wave spectrum has attracted several major wireless operators. This band that covers from 27-29.5 GHz is used for mobile, fixed satellite, fixed point-to-point and marine services across the world (USA, Europe, China and Korea). Path loss and atmospheric absorption are not as severe in this band as that of the 60 GHz band, in addition when used for short distance communications, it poses a potential candidate for multi-GHz bandwidth for very high throughput short range applications such as multimedia and video services. The high loss associated with the high frequency of operation can be compensated by the use of large aperture antennas or antenna arrays.

The design of antenna arrays at mm-wave frequencies is not a trivial task. Efficient as well as cost effective solutions are required for consumer electronic devices. The feeding structures of such arrays are also very challenging to design and optimize. Finally the integration between the antenna arrays and the feeding structures should be done with care.

SUMMARY

The foregoing paragraphs have been provided by way of general introduction, and are not intended to limit the scope of the following claims. The described embodiments, together with further advantages, will be best understood by reference to the following detailed description taken in conjunction with the accompanying drawings.

One embodiment of the disclosure includes a Butler Matrix feeding network; a plurality of power combiners, wherein each power combiner having one input and N outputs, and wherein each power combiner is configured to apply equal phase and power to a phase distributed output signal generated by the Butler Matrix feeding network and generate N processed signals; and a plurality of millimeter wave switched beam planar antenna arrays having at least 1.5 GHz of bandwidth and located on a top low loss dielectric substrate, wherein each antenna array has N elements, and wherein each antenna array is configured to obtain direct and narrow width beams from the N processed signals combined by each of the power combiners.

In another embodiment, the Butler Matrix feeding network comprises one or more hybrid couplers, one or more crossovers and one or more phase shifters.

In another embodiment, the Butler Matrix feeding network includes M input signals and M output signals, wherein each of the M input signals is excited at a different time and generates a different phase distributed output signal.

In another embodiment, the millimeter wave switch beam antenna arrays comprise a plurality of slot type antenna arrays having adjustable sizes, and the slot type antenna arrays comprise: an extra ground plan extension on the top substrate, and a bottom substrate directly beneath the top substrate without a middle substrate, wherein the bottom substrate comprises the Butler Matrix feeding network, the plurality of power combiners, and a plurality of feeding lines on the bottom substrate, each of the feeding lines terminating a corresponding slot on the top substrate.

In another embodiment, the apparatus is integrated in a multi-layer printed circuit board including: a bottom dielectric substrate, comprising the Butler Matrix feeding network, the plurality of power combiners, and a plurality of feeding microstrip lines; a middle layer dielectric substrate between the top dielectric substrate and the bottom dielectric substrate, comprising a ground plane with a plurality of coupling slits; and the top substrate comprising a plurality of printed rectangular patches, each patch with a length and a width extending beyond the size of the array to accommodate the Butler Matrix feeding network.

In another embodiment, the apparatus can be inserted in a handheld portable consumer electronic device for short range communication.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 1(*a*) shows a geometry of a possible planar printed antenna array operating at mm-wave frequencies.

FIG. 1(*b*) shows a cross-section of the integrated planar printed antenna array with the feeding of the antenna via field coupling through a ground plane slot.

FIG. 1(*c*) shows a cross-section of the integrated planar printed antenna array with the feeding of the antenna via a connecting line.

FIG. 2(*b*) shows a 4×4 Example of a Butler Matrix with the internal components.

FIG. 4(*b*) shows a middle layer of the integrated 4×4 planar antenna array fed from a 4×4 Butler Matrix.

FIG. 4(*c*) shows a bottom layer of the integrated 4×4 planar antenna array fed from a 4×4 Butler Matrix.

FIG. 4(*d*) shows a side view of the integrated 4×4 planar type antenna array fed from a 4×4 Butler Matrix architecture.

FIG. 5(*b*) shows a bottom layer of the integrated 4×4 slot type antenna array fed from a 4×4 Butler Matrix.

FIG. 5(*c*) shows a cross sectional view of the integrated 4×4 slot type antenna array fed from a 4×4 Butler Matrix architecture.

DETAILED DESCRIPTION

Figure 2A:
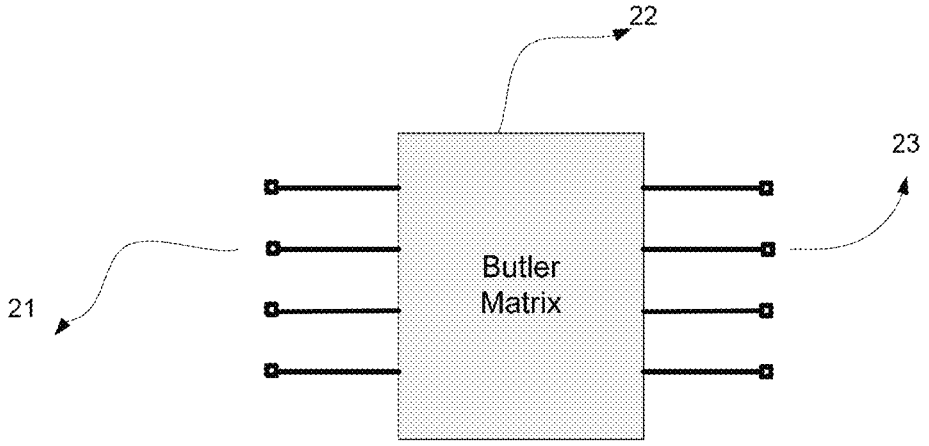
FIG. 2(*a*) shows the block diagram of a Butler Matrix feed network.

Referring now to the drawings, wherein like reference numerals designate identical or corresponding parts throughout the several views.

A switched mode antenna array for mm-wave frequencies targeting consumer electronic devices and short range communications is described. An specific example operating at a center frequency of 28.5 GHz is described. The antenna array includes printed antenna elements (i.e. patch or slot antennas) built on a low loss substrate that can withstand mm-wave frequency operation. In addition, the switched beam/mode operation may be provided via a specialized Butler Matrix feed network that is not feeding a single element per feed point but rather an array of elements. The integrated design consisting of the planar antenna array and the Butler Matrix is very compact and can fit within portable consumable electronic devices.

Multiple-Input-Multiple-Output capability can be utilized by integrating several arrays of this mm-wave switched design within a user terminal to provide even more throughput via the simultaneous data links between the two devices having multiple arrays within each of them.

The disclosed system consists of two major components, the antenna array and the feed network. FIG. 1(*a*) shows the geometry of a possible planar printed antenna array operating at mm-wave frequencies 111. The planar array 111 consists of printed antenna elements 110 with certain width 105 and length 104 according to their type (patch, slot, etc.), that are organized with horizontal inter-element spacing of 107 and vertical spacing 102. These two dimensions will affect the generated sidelobes. Usually these two inter-element spacing are designed for one half the operating wavelength. The printed antenna elements are placed on a dielectric substrate with length of 106 and width of 109. The edges of the substrate extend 108 and 101 from the edges of the antenna elements.

The side view of a single element is shown in FIGS. 1(*b*) and (*c*). Two feeding mechanisms are shown in FIGS. 1(*b*) and (*c*). More specifically, in FIG. 1(*b*), feeding the antenna 113 (exciting it) via field coupling through a ground plane slot 116 is shown. The feeding line in the bottom layer 117 couples the field to the top antenna element via the ground slot 116. The ground plane is in the middle layer 112 between the feeding structure and the antenna. The antenna is placed on a dielectric substrate 114 and the feeding microstrip line is placed on another substrate 115. The two substrates are separated by the GND plane 112. Another way of feeding the antenna element is via a connecting line (a via) 118 as shown in FIG. 1(*c*). The feeding microstrip line on the bottom layer 119 feeds the via 118 that passes through a slot 120 in the ground plane through the two dielectric layers to the antenna elements on the top layer. The proposed design is not limited to these two feeding mechanisms and any other method can be devised.

Figure 2B:
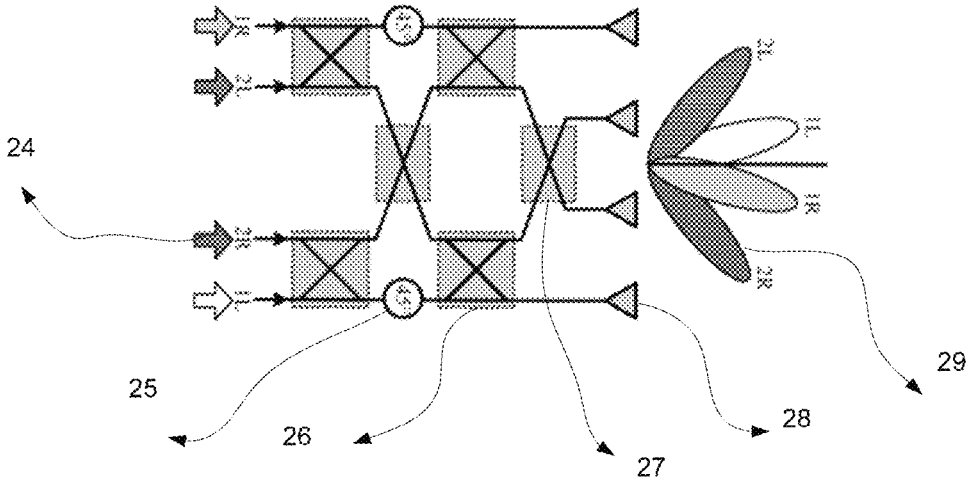

The second major component in the proposed design is the feeding network. FIG. 2(*a*) shows the block diagram of such a feed network. The network consists of M input ports 21 and N output ports 23, thus usually declared as M×M Butler Matrix. Usually the ports are powers of 2, i.e. 4×4, 8×8, etc., but other combinations also exist. The heart of the Butler Matrix 22 consists of Hybrid couplers, crossovers and phase shifters that can be implemented in variety of ways. Some utilize planar microstrip forms, others use multi-layer implementations to shrink the size. A 4×4 Example of a Butler Matrix showing the internal components is shown in FIG. 2(*b*). The inputs 24 are excited one at a time. Each excitation generates a different phase distribution at the output ports that are feeding a linear antenna array 28. The different phase values at the output ports are controlled by Hybrid couplers 26, phase shifters 25 and cross overs 27. The final radiation pattern (beam) generated from this configuration will be switched to four directions based on which input port has been activated as shown in 29. This is the basic operation and structure of a Butler matrix. This can be extended to other M×M configurations.

Figure 3:
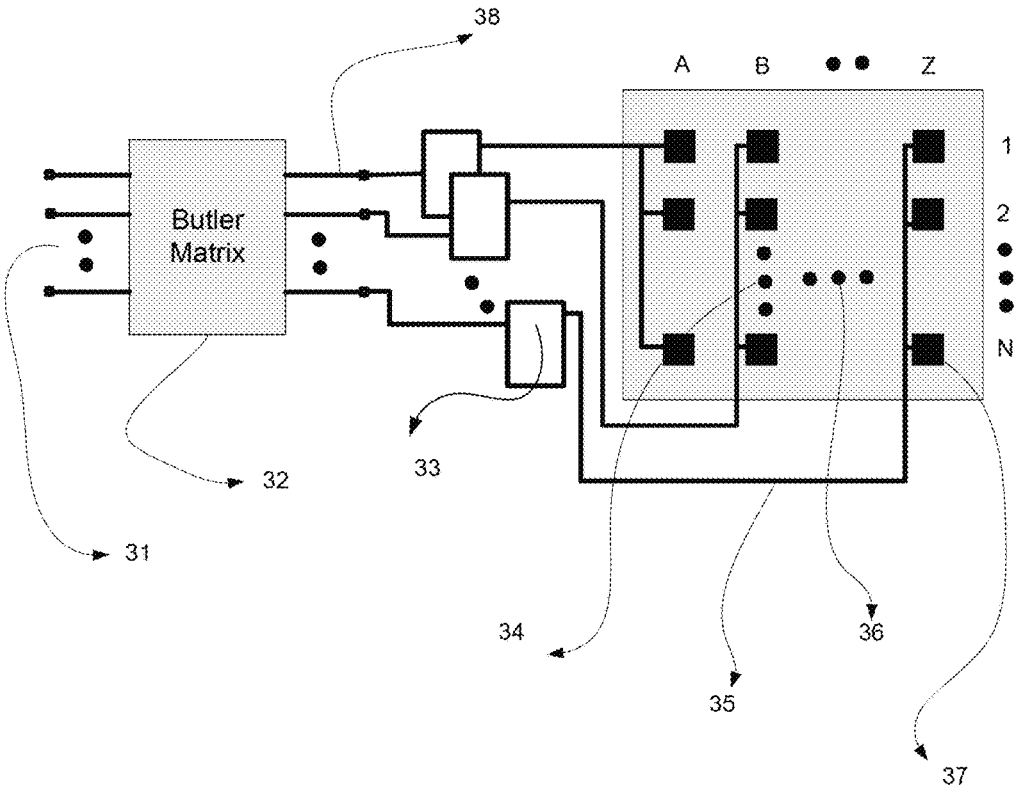
FIG. 3 shows an mm-wave switched beam antenna system.
Figure 4A:
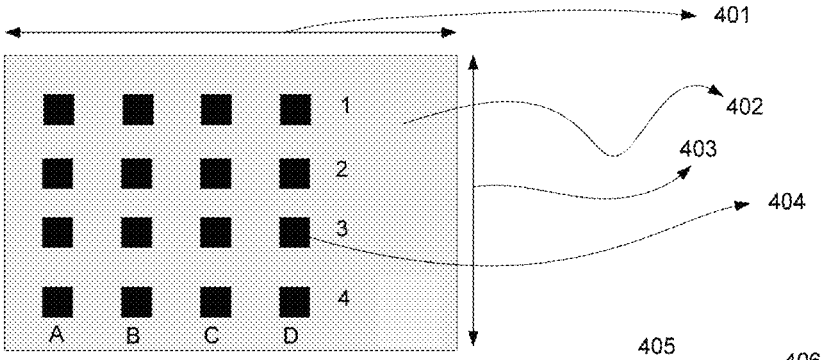
FIG. 4(*a*) shows a top view of the integrated 4×4 planar antenna array fed from a 4×4 Butler Matrix.
Figure 4B:
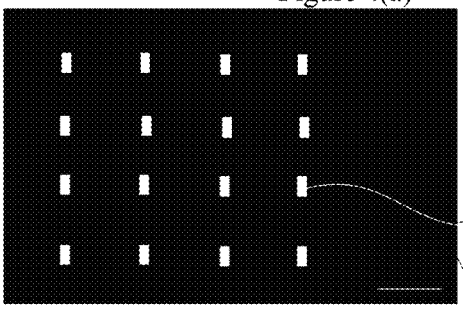
Figure 4D:
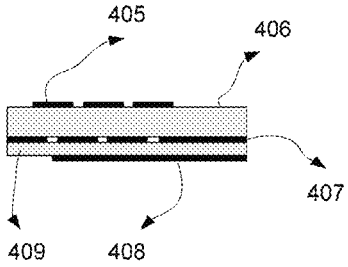
Figure 4C:
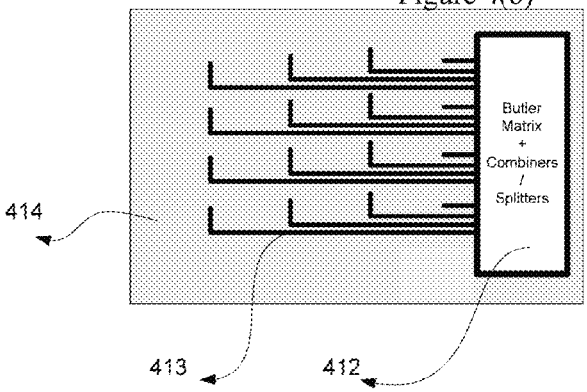

The mm-wave switched beam antenna system is depicted in FIG. 3. The inputs 31 are excited one at a time and feed the Butler Matrix 32. Each output of the Butler Matrix 38 feeds a power combiner that branches to N outputs with equal phase and power (1:N) 33. The N outputs of each power combiner feed an N-element linear printed antenna array 37. Based on the number of the Butler Matrix output ports, we will have different number of linear arrays within the planar array 36, and the number of combiner outputs will determine the number of antenna elements within the single linear array 34 (or N). This way utilizes a planar antenna structure fed by a linear Butler Matrix, which is different than what is usually used for switched Beam arrays. This way, more directive and narrower beam widths can be obtained compared to the regular ways of switched beam arrays.

FIG. 4 shows a possible top view (a) of the integrated design that shows a 4×4 antenna array fed from a 4×4 Butler Matrix. The dielectric substrate has a length of 401 and a width of 403 that extends a little beyond the size of the array to accommodate the feed network at the bottom layer of the multi-layer PCB 402. The planar antenna array 404 is shown and numbered from 1-4 and A-D for the rows and columns, respectively. The middle layer that has the ground plane 411 with coupling slits 410. The bottom layer 414 has the Butler Matrix 412 and the feeding microstrip lines 413. A side view is shown in FIG. 4(*d*) where the top antennas 405 are situated on the top dielectric layer 406 and the middle ground layer with its coupling slits 407 comes next, followed by the bottom dielectric substrate 409 that has the Butler Matrix and the coupling lines 408 printed on.

Figures 5A, 5B, 5C:
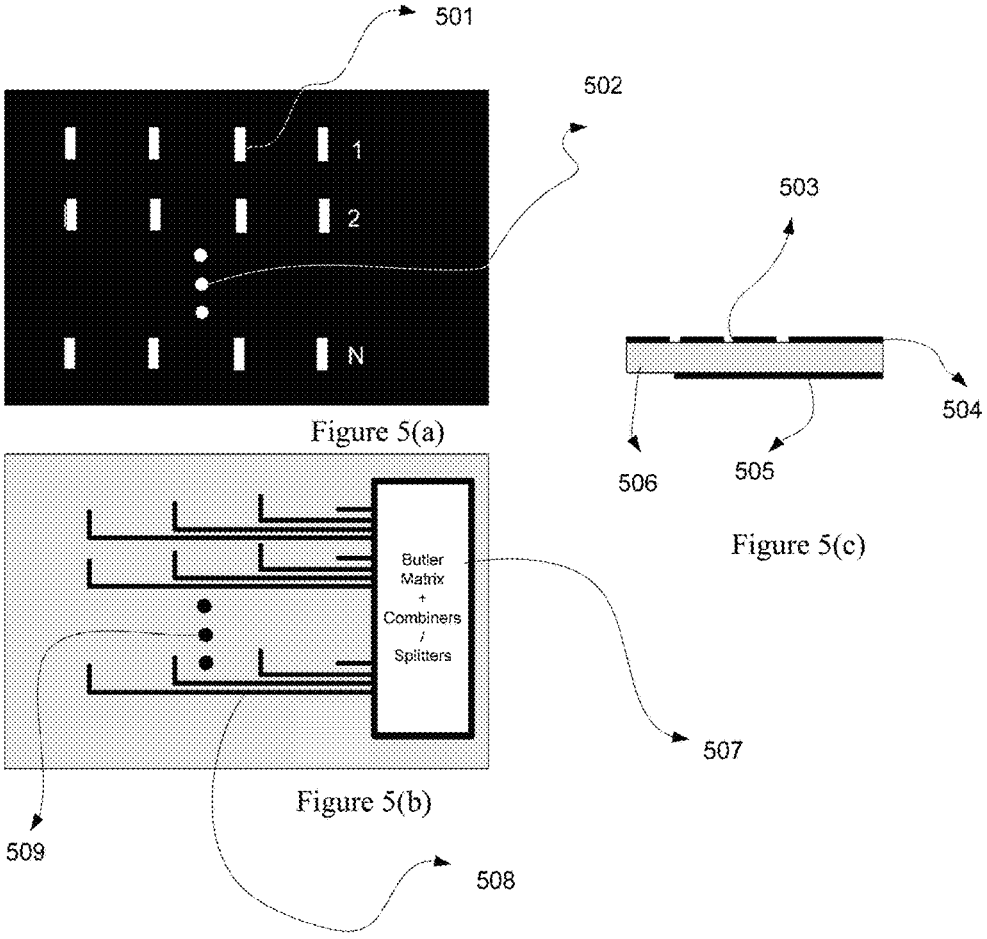
FIG. 5(*a*) shows a top view of the integrated 4×4 slot antenna array fed from a 4×4 Butler Matrix.

Another possible configuration for this mm-wave switched beam antenna array is shown in FIG. 5. In this configuration, slot type antennas are utilized instead of printed rectangular patches. This design eliminates one extra dielectric layer. FIG. 5(*a*) shows the slot antennas within the ground plane 501 with an array size that can be adjustable 502. The bottom layer is shown in FIG. 5(*b*) where the Butler Matrix 507 and the feeding lines 508 terminate below their respective slots in the top layer. Again this design can be adjusted with multiple outputs based on the M values of the Butler Matrix 509. A cross sectional view of this architecture is shown in FIG. 5(*c*). The top layer 503 contains the slot antennas that are mounted on the main substrate 506 with an extra ground plane extension 504 that is needed for the bottom layer Butler Matrix 505.

Figure 6:
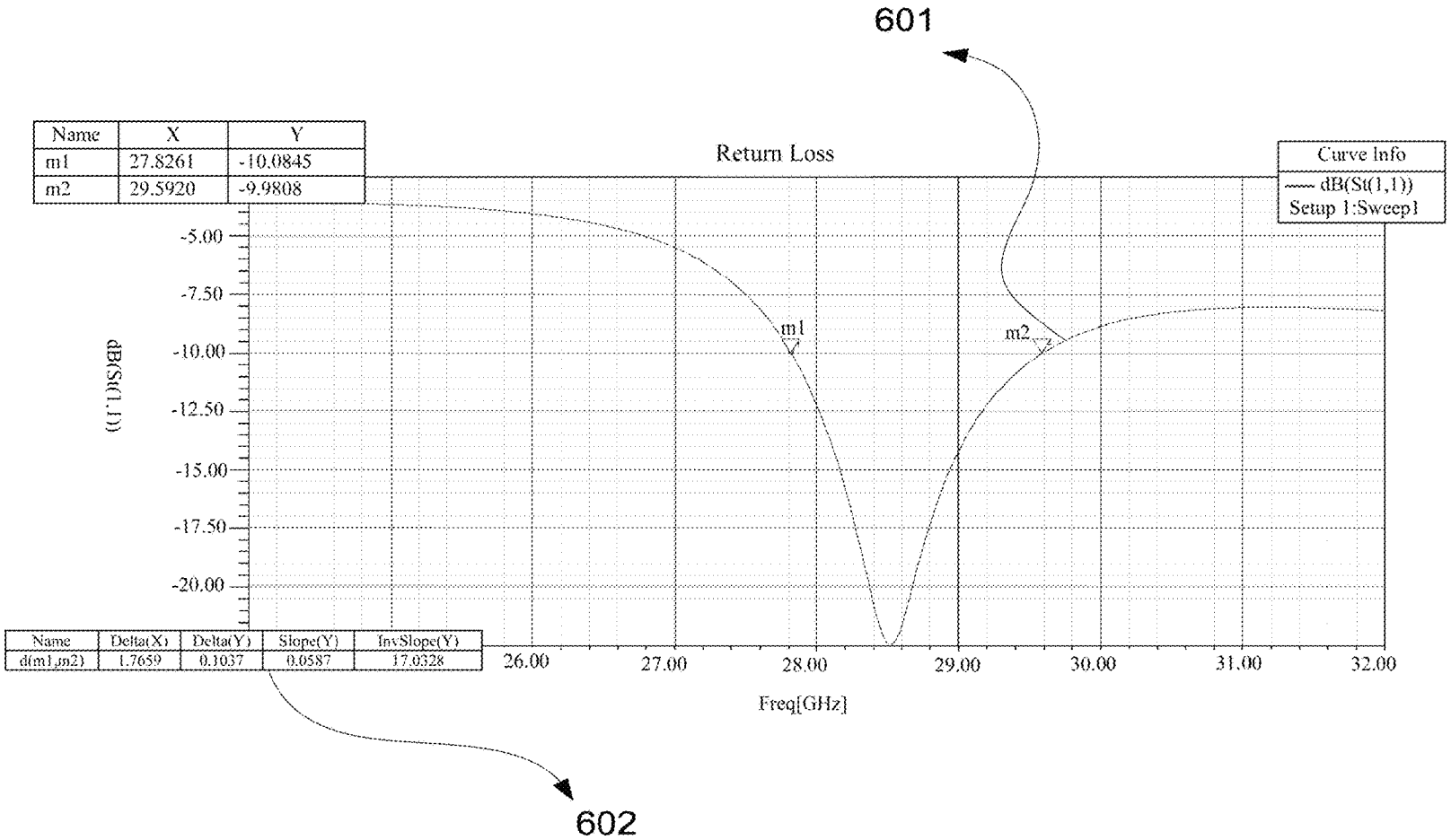
FIG. 6 shows the resonance and bandwidth behavior of a single element slot antenna operating at 28.5 GHz.
Figure 7:
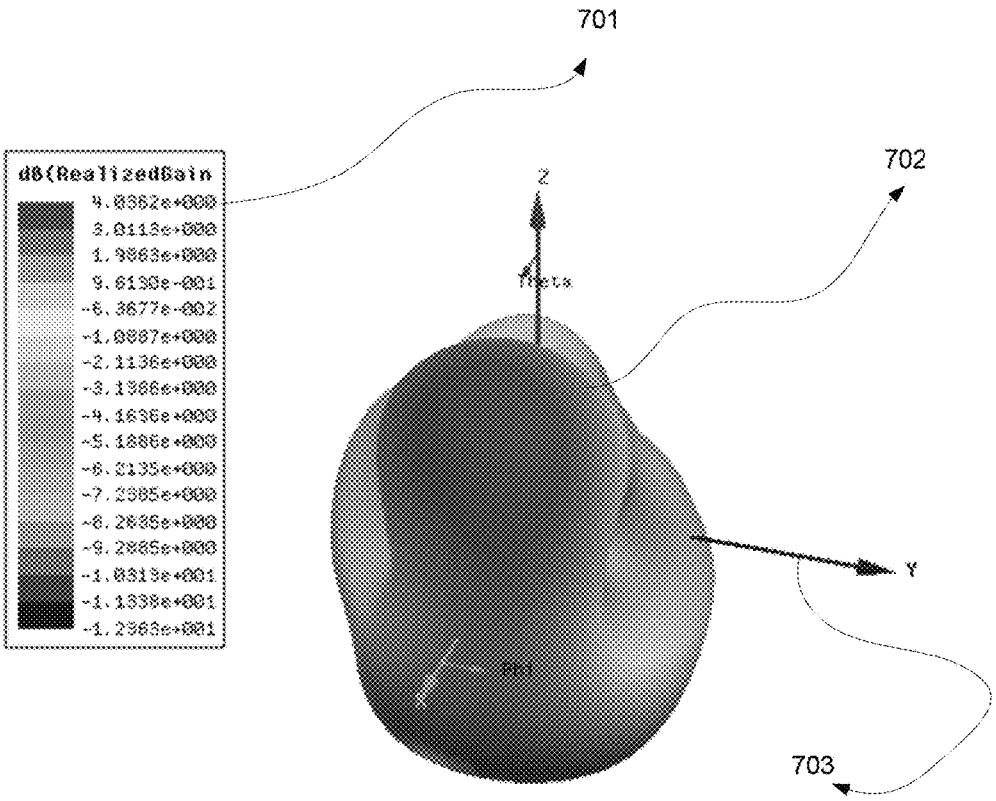
FIG. 7 shows the three dimensional gain pattern shape of this antenna in the x-y-z coordinate system.

FIG. 6 shows the resonance 601 and bandwidth 602 behavior of a single element slot antenna operating at 28.5 GHz. It is evident that the bandwidth covers more than 1.5 GHz that will easily accommodate true multimedia and high definition TV wireless transfer for short ranges using this antenna element. The three dimensional gain pattern shape 702 of this antenna is shown in FIG. 7 in the x-y-z coordinate system 703. The maximum gain obtained from a single element can be 4 dBi. Other antenna elements can be utilized here as well. And different operating frequencies within the mm-wave spectrum can be devised.

Figure 8:
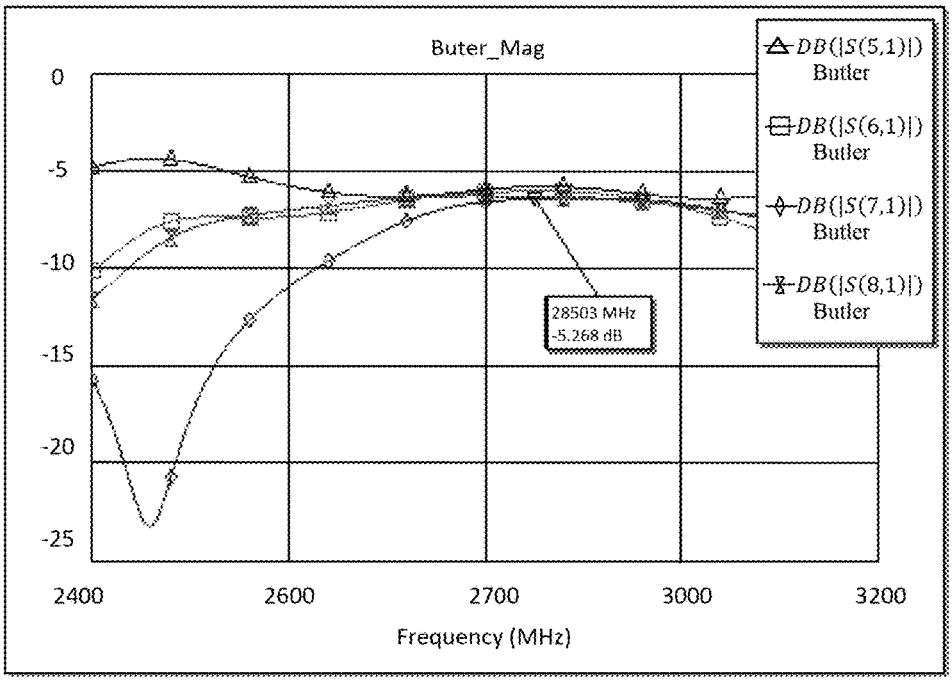
FIG. 8 shows magnitudes of the Butler Matrix operating at 28.5 GHz.
Figure 9:
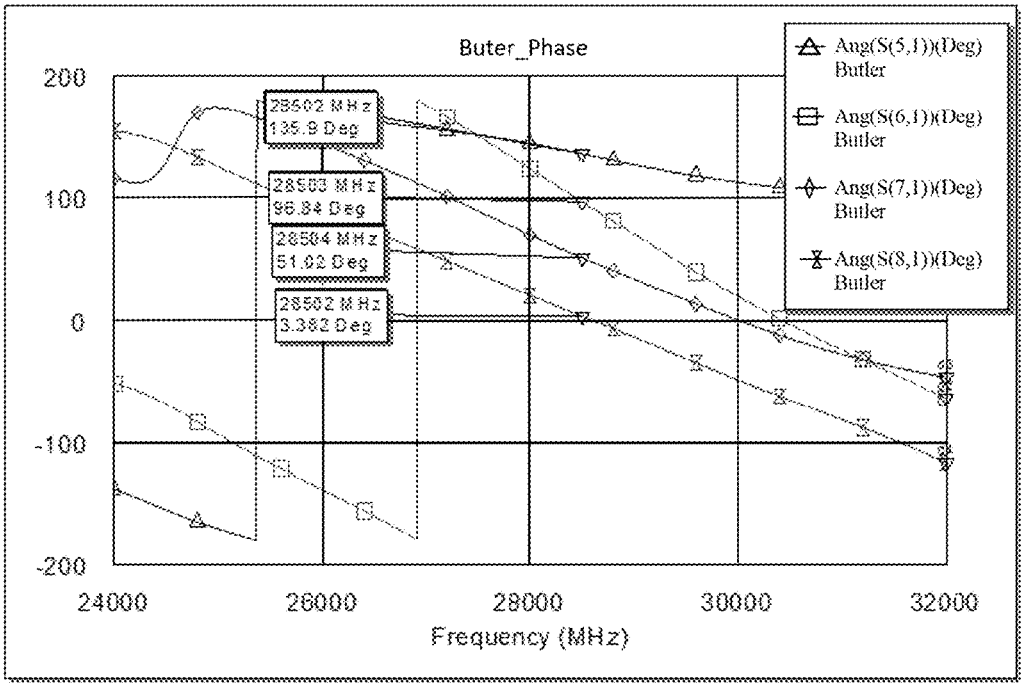
FIG. 9 shows phases responses of the Butler Matrix operating at 28.5 GHz.

The magnitude and phase responses of the Butler Matrix operating at 28.5 GHz are shown in FIGS. 8 and 9, respectively. In FIG. 8, the magnitude of the powers is the outputs of a 4×4 Butler Matrix are shown. Equal power division is obtained over 500 Hz of Bandwidth. IN addition, the phases relations between the various output ports are shown in FIG. 9, the 45 degree phase difference is maintained showing good performance from this feed network that will aid in the beam switching capability.

Figure 10:
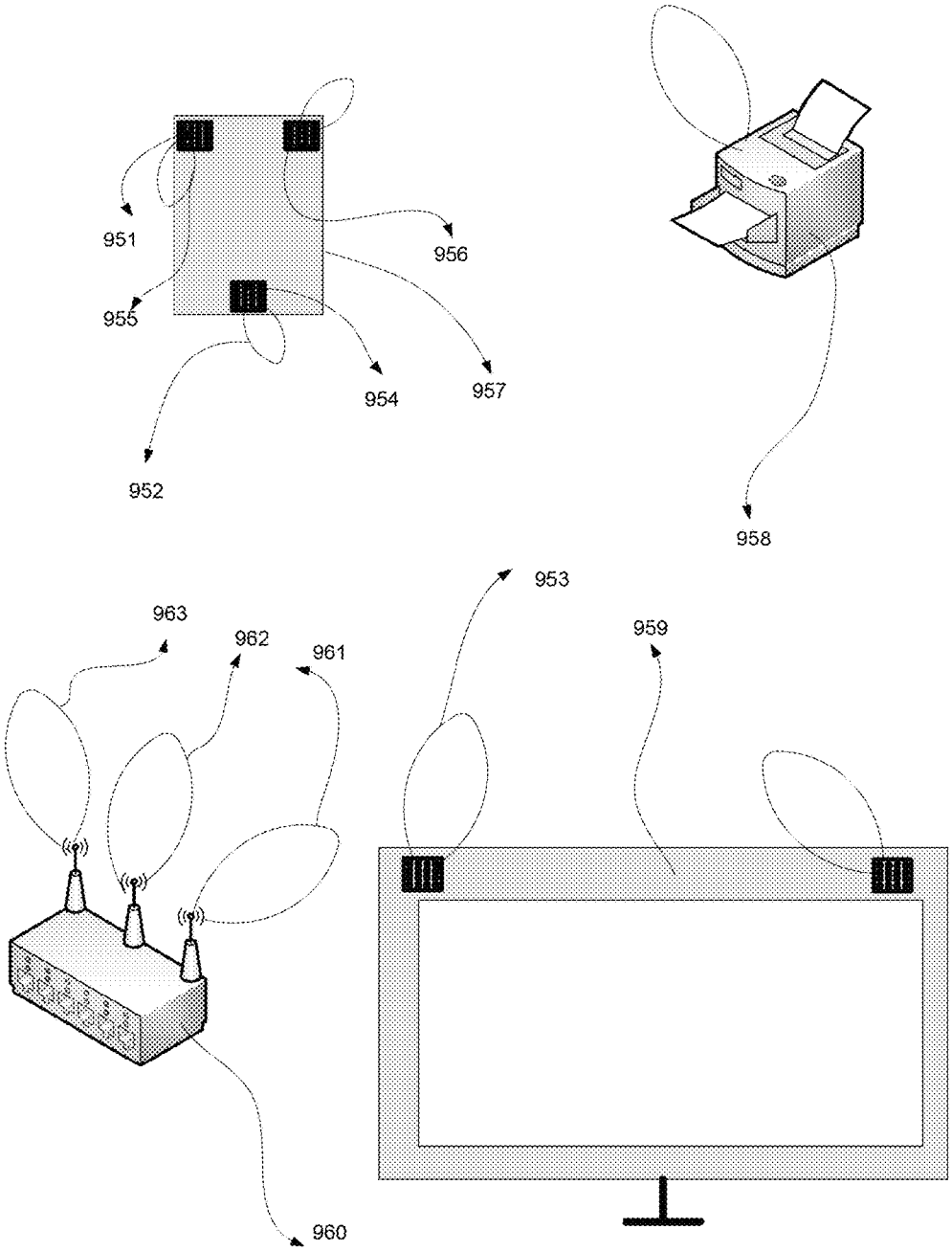
FIG. 10 shows an exemplary short range communication system scenario with MIMO capabilities.

The single beam switching array can be used in multiple-input-multiple-output (MIMO) antenna systems. One possible application scenario in the mm-wave short distance communication regime is shown in FIG. 10. A Mobile terminal 957 that has three switched beam mm-wave antenna arrays 951, 954 and 956 each working as a transmitter or receiver can establish three beams in three different radiation directions 955, 952, 956 simultaneously to communicate with other devices such as printers 958 in close proximity, wireless routers and hubs 960 with three different radiation patterns 963, 962, 961, to establish true high throughput MIMO data transfers, or with TV sets 959 with multiple beams for high definition wireless data and movie transfers 953.

The invention claimed is:

1. A mm-wave antenna apparatus with beam steering function comprising:

a Butler Matrix feeding network having a plurality of outputs and includes a plurality of input signals and a plurality of output signals in a power of 2 matrix combination;

a plurality of power combiners, each power combiner having N outputs and one input configured to receive a respective output from the Butler Matrix feeding network, wherein each power combiner is configured to apply equal phase and power to a phase distributed output signal generated by the Butler Matrix feeding network and generate N processed signals; and a plurality of millimeter wave switched beam planar antenna arrays having at least 1.5 GHz of bandwidth and located on a top low loss dielectric substrate, wherein each antenna array has N elements configured to receive the N processed signals from the N outputs of each respective power combiner, and wherein each antenna array is configured to obtain direct and narrow width beams from the N processed signals combined by each of the power combiners, wherein the apparatus is integrated in a multi-layer printed circuit board including:

a bottom dielectric substrate having the Butler Matrix feeding network, the plurality of power combiners, and a plurality of feeding microstrip lines, and a middle layer dielectric substrate between the top low loss dielectric substrate and the bottom dielectric substrate and having a ground plane with a plurality of coupling slits, wherein the top substrate extends beyond the size of the arrays to accommodate the Butler Matrix feeding network.

2. The apparatus of claim 1, wherein the Butler Matrix feeding network includes one or more hybrid couplers, one or more crossovers and one or more phase shifters.

3. The apparatus of claim 1, wherein the Butler Matrix feeding network includes M input signals, wherein each of the M input signals is excited at a different time and generates a different phase distributed output signal.

4. The apparatus of claim 1, wherein the apparatus can be inserted in a handheld portable consumer electronic device for short range communication.

5. The apparatus of claim 1, wherein the amount of millimeter wave switched beam planar antenna arrays is based on the number of outputs of Butler Matrix feeding network.

6. The apparatus of claim 1, wherein the number of N elements of each antenna array is based on the total number of outputs of the power combiners.

7. A handheld portable consumer electronic device comprising the apparatus of claim 1.

* * * * *